United States Patent [19]

Lehmann

[11] 4,047,274

[45] Sept. 13, 1977

[54] SUPPORT FOR CONTINUOUSLY CAST HOT METAL COMPONENTS

[75] Inventor: Rolf Lehmann, Mutschellen, AG, Switzerland

[73] Assignee: Escher Wyss Limited, Zurich, Switzerland

[21] Appl. No.: 714,365

[22] Filed: Aug. 16, 1976

[30] Foreign Application Priority Data

Aug. 18, 1975 Switzerland ..... 10705/75

[51] Int. Cl.[2] ..... B65G 47/00

[52] U.S. Cl. ..... 29/121.4; 29/121.6

[58] Field of Search ..... 29/121.1, 121.2, 121.4, 29/121.6, 127, 128

[56] References Cited

U.S. PATENT DOCUMENTS

| | | | |
|---|---|---|---|
| 696,138 | 3/1902 | Gerdtzen | 29/127 X |
| 840,106 | 1/1907 | Bowditch | 29/121.1 X |
| 2,822,779 | 2/1958 | Schroeder | 29/121.6 X |

FOREIGN PATENT DOCUMENTS

| | | | |
|---|---|---|---|
| 569,214 | 1/1933 | Germany | 29/121.4 |

*Primary Examiner*—Alfred R. Guest

*Attorney, Agent, or Firm*—Pennie & Edmonds

[57] ABSTRACT

Apparatus is disclosed for supporting hot metal components such as slabs in a continuous casting plant which comprises a roll having at least one elongated member which defines a series of undulations disposed about the outer surface of the roll. Preferably the elongated member forms a series of intermeshing separate or continuous coils which extend over the portion of the roll adapted to support the hot metal components. The coils are secured to the roll surface at positions spaced thereabout and are spaced from each other a distance such that the undulations of adjacent coils intermesh so as to provide shielding of the outer surface of the roll from direct contact with the radiant heat from the hot metal components.

14 Claims, 6 Drawing Figures

SUPPORT FOR CONTINUOUSLY CAST HOT METAL COMPONENTS

BACKGROUND OF THE INVENTION

1. Field of the Invention

The present invention relates to a support or backup roll for supporting hot metal components, more particularly slabs in a continuous casting plant.

2. Description of the Prior Art

The surfaces of known rolls of this type are usually subjected to very high temperatures through direct contact with the red hot metal which is usually steel. To accomodate the high temperatures, the roll is intensively cooled so that the roll surface directly in contact with the hot metal slab becomes red-hot and is then cooled. The surface of such support rolls are thus subjected to high alternating stresses due to the intensive heating and cooling which produce fissures in the roll surfaces. I have invented a roll for supporting such hot metal components which is of a relatively simple construction and avoids the disadvantages of the prior art while having a greatly increased operating life.

SUMMARY OF THE INVENTION

The invention relates to an apparatus for supporting continuously cast hot metal components which comprises a generally cylindrical roll member having at least one member positioned thereabout, said member defining a series of interconnected undulations secured to surface portions of said roll member at positions spaced thereabout and adapted to support said hot metal components. Preferably an elongated member such as a rod or bar is configured to form at least one coil defining a series of undulations. Either a continuous spirular coil or a plurality of individual endless coils may be provided. The rod or rods are corrugated to define a series of undulations spaced from each other and in intermeshing relation to provide extensive shielding of the outer surface of the roll member from direct contact with the radiant heat from the red-hot metal slab. The elongated member or members may form one or more coils which are secured to the outer surface portions of the roll member at positions spaced thereabout so that the elongated member can expand freely between these positions, the expansions being further facilitated by the undulations of the elongated member.

Preferably, the undulations of the elongated member have substantially straight portions which extend at acute angles to one another and are interconnected by substantially circular arcuate portions. In this way, minimum distances may be maintained between the parallel straight portions of the intermeshing undulations.

The elongated member may be advantageously secured to the outer surface of the roll by weld spots in the region of the arcs with at least one freely expandable arc being provided between each pair of adjacent weld spots. This manner of securing the elongated member to the roll is particularly simple and resistant, while, in addition, the intermediate space between individual arcs of intermeshing undulations is used for attaching the undulations to the roll surface.

The coils of the elongated member may be in the form of a plurality of closely spaced rings which encircle the roll. Alternatively, the coils may be formed by winding the elongated member helically about the outer surface of the roll. Either arrangement may be advantageous depending on the method used to manufacture the roll.

In its basic preferred form, the elongated member may have a circular cross-sectional configuration.

In the preferred embodiment, the elongated member may have a cross-section with parallel bearing surfaces for the roll surface and for the metal slab and with side faces having portions which extend beneath the side faces of adjacent undulations of the elongated member. In such an arrangement, the outer surfaces of the intermeshing coils adapted to support the hot metal slabs are relatively smooth while at the same time the roll surface is protected from radiant heat by their overlapping side faces.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 2:
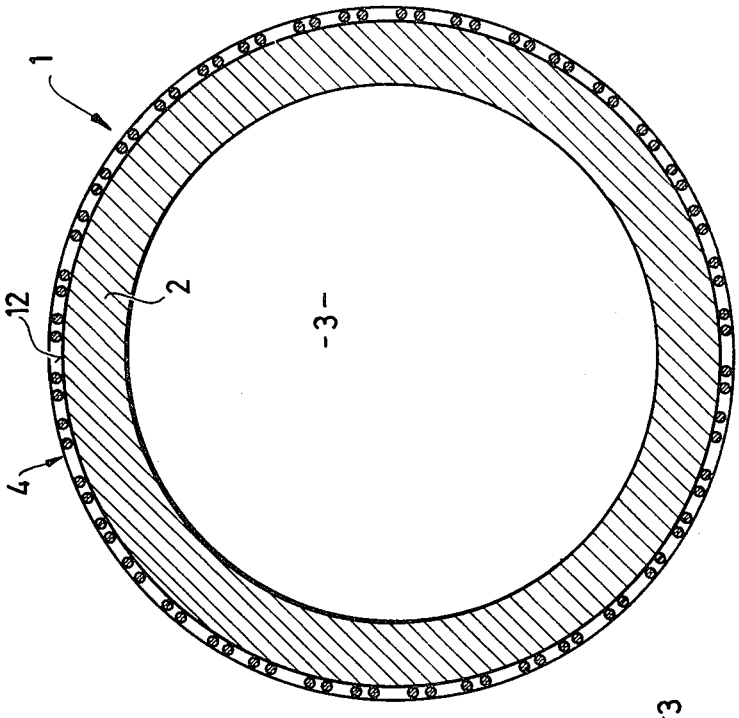
FIG. 2 is a sectional view taken along lines II—II of FIG. 1.
Figure 1:
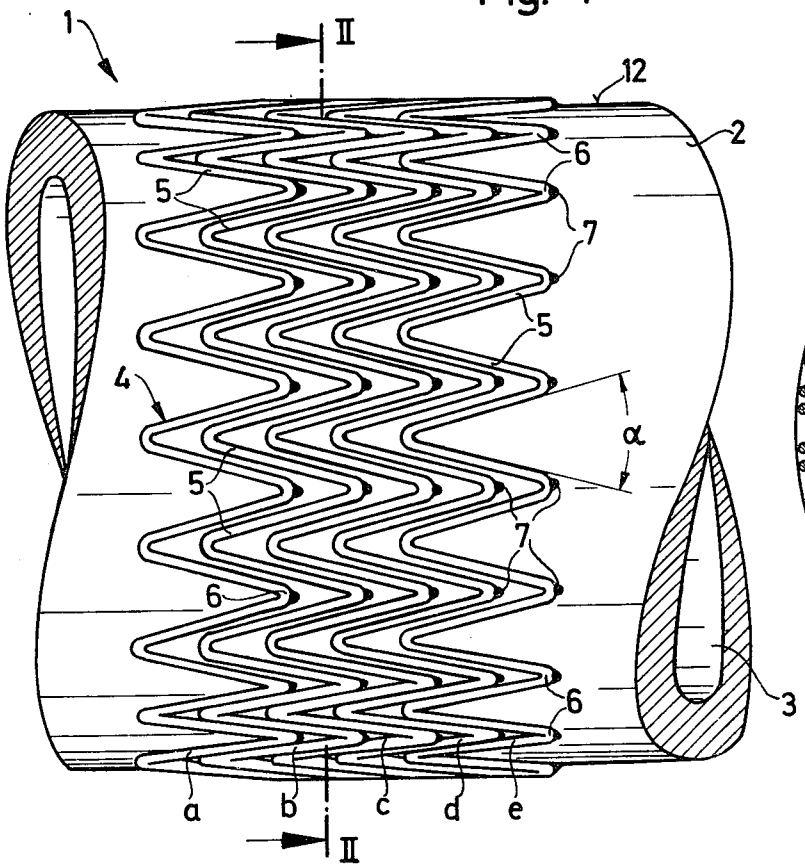
FIG. 1 is an elevational view of a portion of a roll member constructed in accordance with the invention.

Referring now to the drawings, FIGS. 1 and 2 show a portion of a roll shell or barrel 2 of a support or backup roll 1 for a continuous casting plant. The roll shell contains a central cavity 3 which, for example, may be filled with water for cooling the roll. Alternatively, the cavity 3 may contain a support beam of a sag-compensating roll having hydrostatic support elements on which the roll shell 2 is rotatably supported. Sag-compensating rolls of this kind are disclosed, for example, in U.S. Pat. No. 3,802,044 to Spillmann et al.

As shown in FIG. 1, the outer surface of the roll barrel 2 is provided with a layer of corrugated rod or bar material 4 which forms one or more coils defining a series of undulations spaced a distance from each other such that the undulations of adjacent coils or coil portions intermesh. The undulations have straight portions 5 which extend at an acute angle $\alpha$ from one another and are interconnected by circular arcs 6.

The undulatingly configured rod or bar is secured to the outer surface 12 of the roll shell 2 by weld seams 7 in the region of the arcs 6. The weld seams 7 are preferably spotwelded portions which are spaced about the roll shell so that there is always at least one freely expandable arc 6 disposed between each of two adjacent weld seams.

The coils of the undulating rod or bar material may be in the form of closely spaced individual rings *a, b, c, d,* and *e* each encircling the roll 1. In such an arrangement, the rings may be formed from sections of the rod or bar material 4 before they are mounted on and secured to the roll shell 2.

Alternatively, the supporting roll may be constructed by winding the undulating rod or bar material helically about the roll 1, for example from a reel, each turn being pushed against the preceding turn and then welded to the roll shell 2 at points 7.

Figure 4:
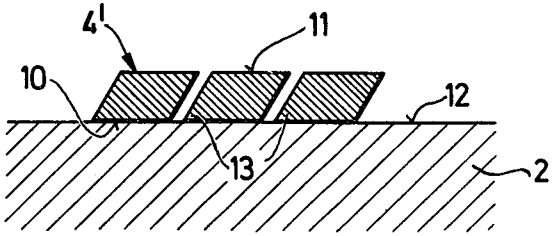
FIGS. 4 to 6 are cross-sectional views of alternate embodiments of a roll constructed in accordance with the invention.
Figure 6:
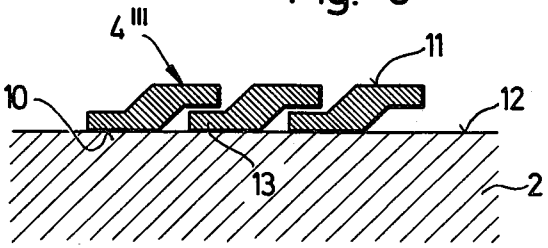
Figure 3:
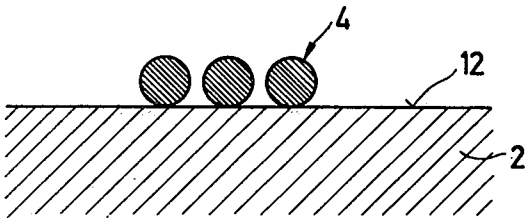
FIG. 3 is an enlarged cross-sectional view of the embodiments of FIG. 1.
Figure 5:
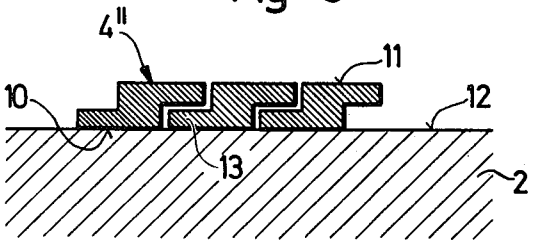

As shown in FIGS. 2 and 3, the rod or bar material 4 preferably has a round cross-section. Alternate embodiments of the invention with other possible and advantageous cross-sectional shapes of the rod or bar material are illustrated in FIGS. 4 to 6. In each of these embodiments, the cross-section of the bar or rod 4', 4'', 4''' shown respectively in FIGS. 4, 5, and 6, is such that its bearing surfaces, that is the outer surface 11 and the inner surface 10 adjacent the surface 12 of the roll shell 2, are parallel to each other. The lateral surfaces of the rod or bar material contain portions 13 which extend beneath a portion of the lateral surface of an adjacent undulation of the bar or rod material so that a portion of each coil overlaps a portion of an adjacent coil.

The use of the support roll of the invention is not limited to continuous casting plants. The roll may also be advantageously used, for example, in rolling mills for rolling rod or bar stock and similar plants.

Although, for reasons of clarity, only a relatively short section of the roll has been shown in FIG. 1 as being provided with a layer of undulating rod or bar material, in actual practice the layer would usually extend over a much larger axial region of the roll.

I claim:

1. An apparatus for supporting hot metal components such as continuously cast slabs produced in a continuous casting plant which comprises a generally cylindrical roll member having at least one generally elongated member configured to form at least one coil defining a series of undulations disposed about surface portions of the roll member, said undulations having substantially straight portions which extend at acute angles to each other and are connected by generally arcuate portions, said coil being secured to surface portions of said roll member at positions spaced thereabout and adapted to support said hot metal components.

2. The apparatus according to claim 1 wherein said elongated member defines undulations having substantially straight portions which extend at acute angles to each other and are connected to each other by substantially circular arcuate portions.

3. The apparatus according to claim 1 wherein said elongated member is secured to the outer surface portions of the roll by spot welded portions in the region of said arcuate portions with at least one freely expandable arcuate portion disposed between each pair of adjacent spot welded portions.

4. The apparatus according to claim 3 further comprising a plurality of undulating members positioned in intermeshed relation to one another.

5. The apparatus according to claim 1 wherein said coil extends about said roll member to form at least one individual ring encircling said roll member.

6. The apparatus according to claim 1 wherein each elongated member is helically wound about said roll member.

7. The apparatus according to claim 1 wherein each elongated member has a substantially circular cross-section.

8. The apparatus according to claim 1 further comprising a plurality of said elongated members positioned in adjacent relation to each other, the outer and the inner surface portions of each elongated member being substantially parallel to each other and to corresponding surface portions of other members to provide a generally continuous outer surface portion for supporting the hot metal components, the side faces of said elongated member having portions which overlap portions of an adjacent elongated member to provide shielding for the roll surface from radiant heat from the hot metal component.

9. The apparatus according to claim 8 wherein each elongated member has a cross-sectional configuration defining a parallelogram and said coils are spaced from each other a distance such that a portion of the outer surface of each coil overlaps a portion of the inner surface of an adjacent coil.

10. The apparatus according to claim 8 wherein each elongated member has a rhombic cross-sectional configuration and said coils are spaced a distance from each other such that a portion of the outer surface of each coil overlaps a portion of the inner surface of an adjacent coil.

11. An apparatus for supporting hot metal components such as slabs in a continuous casting plant which comprises a generally cylindrical roll member mounted for rotation about a generally central axis, at least two elongated members disposed about outer surface portions of said cylindrical member, each elongated member being configured to form at least one coil defining a plurality of adjacent undulations which extend over and generally encircle portions of said cylindrical member adapted to support the hot metal components, said members further being spaced from each other in a manner and at a distance such that the undulations of adjacent coils intermesh each other so as to provide shielding of the outer surface portions of said cylindrical member from direct contact with radiant heat from the hot metal components, and means to secure said coils to said outer surface of said cylindrical member at spaced positions thereabout.

12. An apparatus for supporting continuously cast hot metal components such as slabs which comprises a generally cylindrical roll member defining a generally central opening for reception of a cooling medium, an elongated member such as a rod or bar spirally wound about outer surface portions of said roll member and configured to define a plurality of interconnected undulations positioned in intermeshed spaced relation to support said hot metal components, and welded means to secure said undulations to outer surface portions of said cylindrical roll member at spaced positions thereabout said elongated member thereby forming a support for said hot metal components.

13. An apparatus for supporting hot metal articles, such as continuously cast slabs, which comprises a generally cylindrical roll and at least one elongated member of a substantially circular cross-section configured to form at least one coil extending about said roll and defining a series of interconnected undulations for supporting the hot metal articles and shielding the surface of said roll from direct contact therewith, said coil being secured to surface portions of said roll at discrete positions spaced from each other a distance sufficient to permit said elongated member to expand therebetween when heated by contact with the hot metal articles during operation.

14. The apparatus according to claim 13 wherein said elongated member forms a plurality of said coils, said coils being spaced from each other along the length of said roll a distance such that the undulations of adjacent coils intermesh.

* * * * *